US006419536B1

(12) United States Patent
Oguma

(10) Patent No.: US 6,419,536 B1
(45) Date of Patent: Jul. 16, 2002

(54) DRIVE SHAFT FOR MARINE DRIVE

(75) Inventor: Takahiro Oguma, Hamamatsu (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/644,591

(22) Filed: Aug. 23, 2000

(30) Foreign Application Priority Data

Aug. 24, 1999 (JP) ..... 11-236232

(51) Int. Cl.[7] ..... B63H 23/32
(52) U.S. Cl. ..... 440/83
(58) Field of Search ..... 440/75, 83; 464/179

(56) References Cited

U.S. PATENT DOCUMENTS

| | | | | |
|---|---|---|---|---|
| 2,630,775 A | * | 3/1953 | Kiekhaefer | |
| 3,182,629 A | * | 5/1965 | Armantrout et al. | |
| 3,368,420 A | * | 2/1968 | Alexander, Jr. | |
| 3,487,803 A | * | 1/1970 | Alexander, Jr. | |
| 4,747,796 A | | 5/1988 | Iwai et al. | |
| 4,767,225 A | | 8/1988 | Iio | |
| 4,917,639 A | | 4/1990 | Onoue | |
| 5,499,936 A | * | 3/1996 | McElroy, Jr. | 440/83 |
| 5,749,757 A | | 5/1998 | Suganuma | |
| 6,077,135 A | | 6/2000 | Ito | |

OTHER PUBLICATIONS

Parts Catalogue Model Year 1999, 150 TRX (64C) S150TRX (64C) S175TRX (64D) S200 TRX (64E) L150TRX (64G), in 6 Pages.
Parts Catalogue Model Year 1999 F80 TRX (67G)F100TRX (67F), in 5 Pages.
Parts Catalogue Model Year 2000 F115TRY (68V) LF115TRY (68W), in 5 Pages.
Yamaha Genuine Parts Catalogue Stern Drive, in 3 Pages.

* cited by examiner

*Primary Examiner*—Sherman Basinger
(74) *Attorney, Agent, or Firm*—Knobbe, Martens, Olson & Bear, LLP.

(57) ABSTRACT

A marine drive includes a drive shaft having an upper portion, a lower portion, and at least one waist portion between the upper and lower portions. The upper portion is adapted to be coupled to an engine crankshaft and the lower portion is adapted to be supported by bearings and drives a propulsion device through a transmission. The waist portion has a diameter of generally lesser size than the diameters of the upper and lower portions. The waist portion is tapered so that the diameter of the waist portion at its upper end is greater than the diameter of the waist portion at its lower end. The tapered geometry of the waist portion helps distribute impact forces that may occur when the propulsion device is suddenly locked in position when the engine is still running. As a result, failure and damage to the drive shaft waist portion is reduced.

41 Claims, 4 Drawing Sheets

DRIVE SHAFT FOR MARINE DRIVE

RELATED APPLICATION

This application claims priority to Japanese Application No. 11-236,232, filed Aug. 24, 1999, the entirety of which is hereby incorporated by reference.

BACKGROUND OF THE INVENTION

1. Field of the Invention

The present invention relates to a marine drive, and more particularly to an improved drive shaft for a marine drive.

2. Description of Related Art

Outboard motors typically include a power head supported by a drive shaft housing. A clamping bracket usually secures the drive shaft housing to a transom of an associated watercraft. The drive shaft housing also supports a lower unit that includes a propeller or similar propulsion device. An engine within a cowling of the power head drives the propeller via a drive train. The drive train commonly includes a drive shaft, which extends generally vertically through the drive shaft housing, and a propeller shaft, which lies at about a 90 degree angle relative to the drive shaft. A transmission within the lower unit rotatably couples a lower end of the drive shaft to the propeller shaft.

The drive shaft is usually an elongate bar having an upper portion which couples to the crankshaft of the engine and a lower portion which couples to a gear of the transmission. The lower portion of the drive shaft also usually cooperates with support bearings and the like in order to maintain the drive shaft in a desired journaled mount orientation. An elongate waist portion is defined between the upper and lower portions of the drive shaft. The waist portion is generally free of connectors and various supporting mechanisms. Because of their support functions, the upper and lower portions are generally quite sturdy and have relatively large diameters. The waist portion has a somewhat smaller diameter than the upper and lower portions.

During watercraft operation, the propeller of the outboard motor may accidentally hit a rocky shoal or the like. When this happens, the propeller may be locked in position against a rock and may not be able to rotate even though the engine is still driving the propeller. This exerts a significant impact force on the drive train and can cause extensive damage to the transmission, drive shaft, crankshaft, etc. The waist portion of the drive shaft, with its relatively small diameter, acts to alleviate the impact force on the other components of the drive train. In essence, the waist portion provides a weak link so that the impact force will tend to twist the waist portion, which will absorb much of the impact force, rather than exposing the transmission and crankshaft to the impact force. Although this arrangement buffers much of the drive train from the impact force, it does not protect the drive shaft. As a result, the waist portion of the drive shaft can break or become damaged.

SUMMARY OF THE INVENTION

The present invention provides a drive shaft having a tapered waist portion that is designed to distribute impact forces along its entire length. This allows the waist portion to better absorb the impact force, inhibiting breakage or damage of the drive shaft when the watercraft hits a rocky shoal or the like and the propeller is locked in position with the engine still running.

In accordance with one aspect of the present invention, a marine propulsion unit comprises an engine adapted to drive an output shaft. The output shaft is drivingly engaged with a drive shaft. The drive shaft has a first end portion, a second end portion, and an elongate waist portion disposed between the first and second end portions. The first end portion is driven by the output shaft and the second end portion drives a propulsion device. The waist portion is tapered along its length.

In accordance with another aspect of the present invention, an outboard motor comprises an internal combustion engine adapted to drive a crankshaft. A drive shaft is provided and has a top end, a bottom end, and an elongate waist disposed between the top and bottom ends. The drive shaft top end is coupled to the crankshaft. The elongate waist is tapered so as to have a larger diameter towards the top end than towards the bottom end. The drive shaft bottom end drives a transmission. An output shaft is coupled to the transmission and drives a propulsion device.

In accordance with yet another aspect of the present invention, a drive shaft is provided for use in conjunction with a marine drive. The drive shaft has a first end portion adapted to be coupled to a crankshaft of an internal combustion engine, a second end portion adapted to drive a propulsion device, and an elongate waist portion disposed between the first and second end portions. The waist portion has a first end and a second end and is tapered so that a diameter of the waist portion at the first end is greater than a diameter of the waist portion at the second end.

Further aspects, features and advantages of the present invention will become apparent from the detailed description of the preferred embodiments which follows.

BRIEF DESCRIPTION OF THE DRAWINGS

The annexed drawings illustrate preferred embodiments of the present marine drive. These embodiments, however, are intended to illustrate and not to limit the invention. The drawings contain the following figures.

DETAILED DESCRIPTION OF THE PREFERRED EMBODIMENTS OF THE INVENTION

Figure 1:
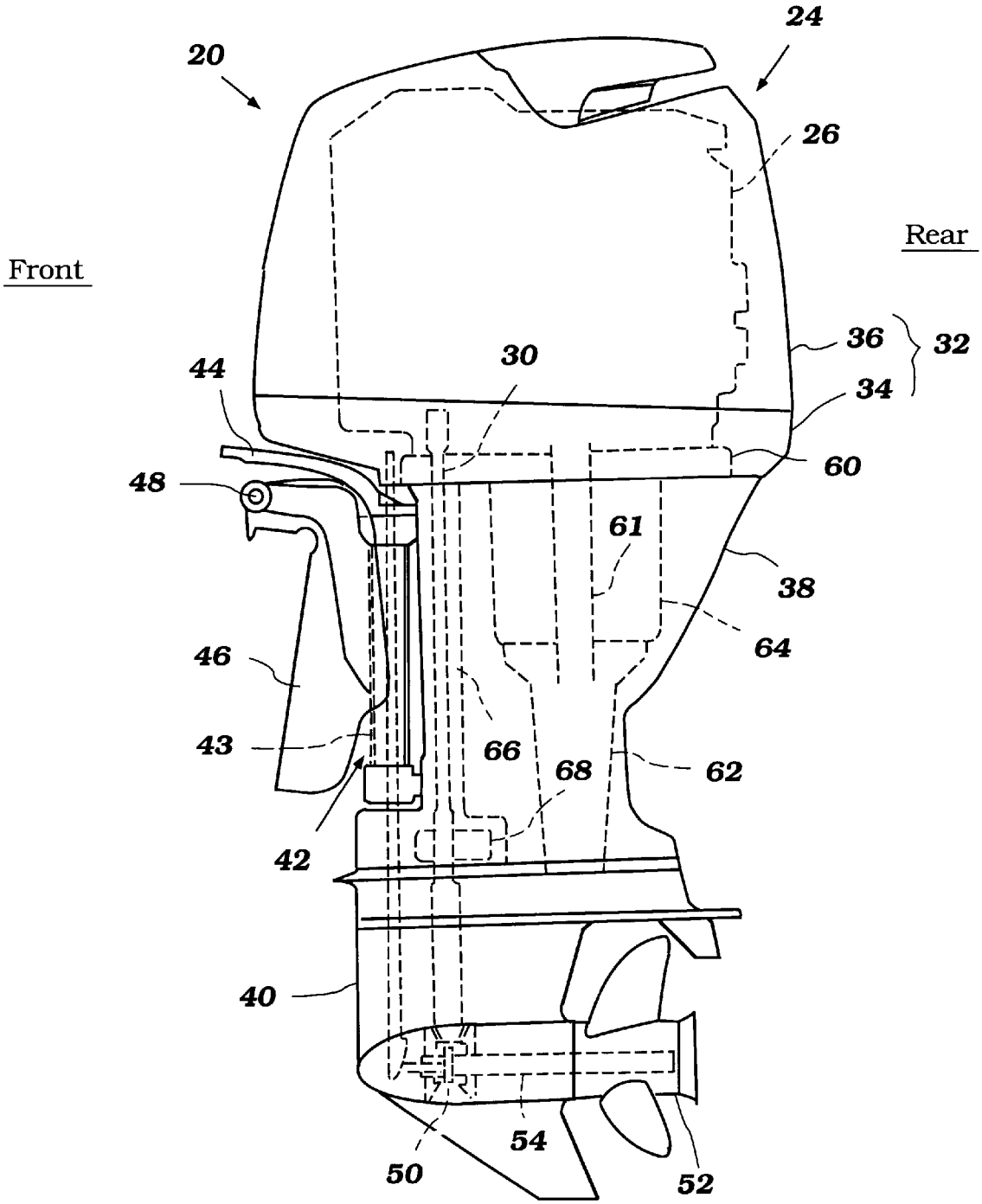
FIG. 1 is a side elevational view of an outboard motor configured in accordance with the preferred embodiment of the present invention, and illustrates several internal components of the outboard motor in phantom.

FIG. 1 illustrates a marine drive 20 which is configured in accordance with a preferred embodiment of the present invention. In the illustrated embodiment, the marine drive 20 is depicted as an outboard motor for mounting on a transom at the stern of a watercraft (not shown). It is contemplated, however, that the principles discussed below can be incorporated into other types of marine drives as well, such as inboard/outboard stern drives and direct drives.

In order to facilitate the description of the present outboard motor 20, the terms "front" and "rear" are used to indicate positions of the outboard motor components relative to a fixed datum: the transom of the watercraft. Thus, as used herein, "front" refers to a position or a side that would be closer to the watercraft transom when mounted thereon, and "rear" refers to a position or side that would be distanced from the ransom.

With initial reference to FIG. 1, the outboard motor 20 has a power head 24 that includes an internal combustion engine 26. It is to be understood that the present outboard motor can include engines having various cylinder arrangements and numbers, as well as varying operating principles. For example, a 2-cycle 4-cylinder in-line engine may be acceptable, as may a 4-cycle 6-cylinder V-type engine. Further, a rotary-type engine may also be acceptable.

As typical with outboard motor practice, the engine 26 is supported within the power head 24 so that a crankshaft of the engine 26 rotates about a generally vertical axis within a crankcase. The crankshaft drives a drive shaft 30 which depends from the power head 24 and rotates about the generally vertical axis, as described below.

As seen in FIG. 1, a protective cowling assembly 32 surrounds the engine 26. The cowling assembly 32 includes a lower tray 34 and a top cowling 36. The tray 34 and cowling 36 together define a compartment that houses the engine 26, with the lower tray 34 encircling a lower portion of the engine 26.

A drive shaft housing 38 extends from the lower tray 34 and terminates in a lower unit 40. The drive shaft 30 extends through the drive shaft housing 38 and is suitably journaled therein for rotation about the vertical axis. Further details regarding the drive shaft 30 are discussed below.

A steering shaft assembly 42 is affixed to the drive shaft housing 38 in a conventional manner. Steering movement occurs about a generally vertical axis which extends through a steering shaft 43 of the steering shaft assembly 42. A steering arm 44, which is connected to an upper end of the steering shaft, extends in a forward direction for manual steering of the outboard motor 20, as known in the art.

The steering shaft assembly 42 also is pivotally connected to a clamping bracket 46 by a pivot pin 48. This conventional coupling permits the outboard motor 20 to be pivoted relative to the pivot pin 48 to permit adjustment of the trim position of the outboard motor 20 and for tilt-up of the outboard motor 20.

Although not illustrated, it is to be understood that a conventional hydraulic tilt and trim cylinder assembly, as well as a conventional steering cylinder assembly, can also be used with the present outboard motor 20. The construction of the steering and trim mechanisms is considered to be conventional, and for that reason, further description is not believed necessary for an appreciation or understanding of the present invention.

An exhaust guide 60 directs engine exhaust into an exhaust pipe 61 which depends into the drive shaft housing 38. Exhaust is further directed into an exhaust passage 62 within the drive shaft housing 38. The exhaust passage 62 preferably directs exhaust into the lower unit 40, from which the exhaust is vented to the environment.

An oil pan 64 is also provided within the drive shaft housing 38 and adjacent to the exhaust passage 62.

The drive shaft 30 depends into the drive shaft housing 38. A drive shaft chamber 66 within the drive shaft housing 38 substantially surrounds the drive shaft 30 and separates the drive shaft from other components within the drive shaft housing 38 such as the exhaust passage 62 and oil pan 64. A water pump 68 preferably is positioned within the drive shaft chamber 66 and adjacent the drive shaft 30.

With continued reference to FIG. 1, the drive shaft 30 continues from the drive shaft housing 38 into the lower unit 40, where it drives a transmission 50. The transmission 50 establishes a driving condition of a propulsion device 52, which can take the form of a propeller, a hydrodynamic jet, or the like. The transmission 50 advantageously is a forward/neutral/reverse-type transmission. In this manner, the propulsion device 52 can drive the watercraft in any of these three operating states.

A propulsion shaft 54 extends from the transmission 50 and supports the propulsion device 52 at its aft end. The transmission 50 transfers power from the drive shaft 30 to the propulsion shaft 54. In the illustrated embodiment, these shafts lie at about a 90° angle relative to each other and the transmission 50 comprises a plurality of bevel gears; however, it is understood that the present invention can be used with a transmission which allows for power transfer at different shaft angles.

Figure 2:
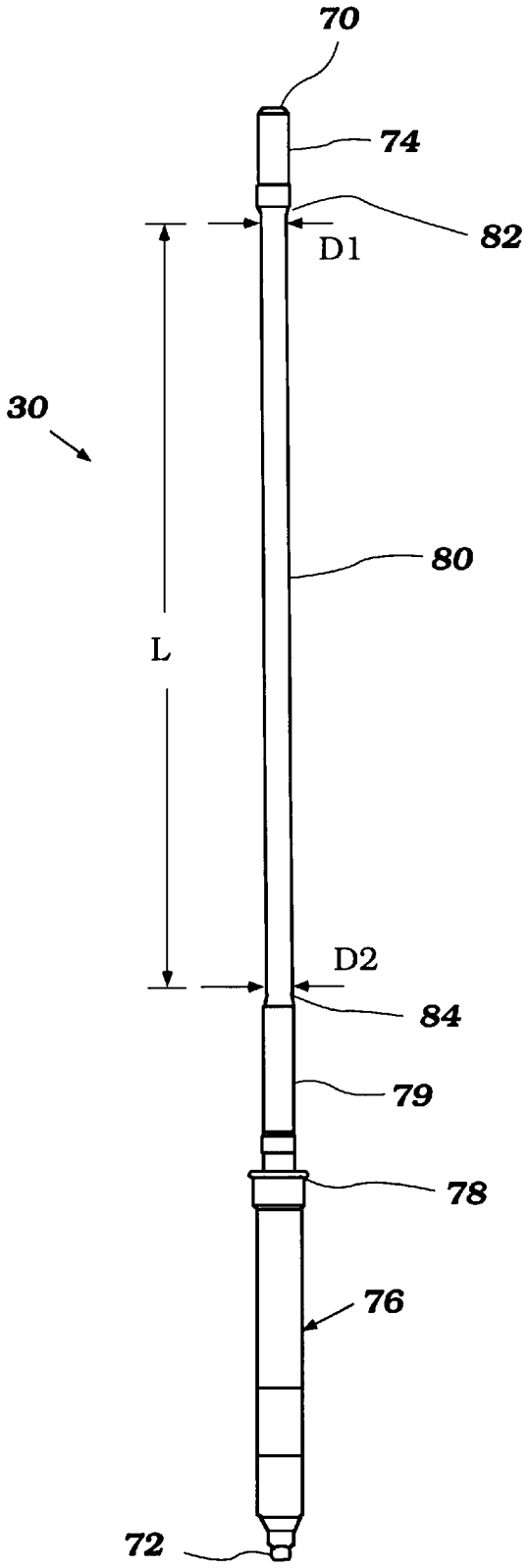
FIG. 2 shows a drive shaft having features in accordance with a first embodiment of the present invention.

With reference also to FIG. 2, the drive shaft 30 preferably comprises an upper end 70 and a lower end 72. An upper portion 74 adjacent the upper end 70 is preferably adapted to be coupled with the engine crankshaft. The lower end 72 is preferably adapted to accept a gear (e.g. a pinion) mounted thereon. The gear is a component of the transmission 50.

A lower portion 76 of the drive shaft is defined adjacent the lower end 72 and is preferably adapted to facilitate secure journaled mounting of the drive shaft 30 within the lower unit 40. One or more thrust flanges 78 can be provided on the lower portion 76. The thrust flange 78 cooperates with a thrust bearing to facilitate a secure journaled mounting of the drive shaft 30 so that it rotates with minimal vibration about a substantially vertical axis. Excessive vibration can lead to early wear of the drive shaft 30 and/or the transmission 50. To facilitate the secure journaled mounting, the diameter of the drive shaft in the lower portion 76 is relatively large.

A water pump drive portion 79 of the drive shaft 30 is provided above the lower portion 76 and is adapted to drive the water pump 68 within the drive shaft chamber 66 of the drive shaft housing 38.

An elongate waist portion 80 is provided between the water pump portion 79 and the upper portion 74 of the drive shaft. The diameter of the drive shaft 30 in the waist portion 80 is preferably significantly smaller than the diameter in the upper or lower portions. As shown in FIG. 2, the waist portion 80 has an upper end 82, a lower end 84, and a length L. A diameter D1 of the waist portion 80 at the upper end 82 is preferably slightly greater than a diameter D2 of the waist portion at the lower end 84. The waist portion 80 is preferably tapered along its length L in a gradual and continuous manner. In the embodiment shown in FIG. 2, the waist has a length L of about 300 millimeters, and the upper diameter D1 is only about 0.5 to 1 millimeter greater than the lower diameter D2.

The waist portion 80 and the water pump support 79 are preferably made of a stainless steel material and the lower portion 76 is preferably made of a chrome steel material. It is to be understood, however, that any suitable material having uniform or varying properties or any suitable combination of materials can advantageously be used. Any conventional manufacturing method can be used to form the drive shaft. Such manufacturing methods may include applying various heat treatments, coatings, and the like.

As discussed above, because the waist portion 80 has a significantly smaller diameter than the upper and lower portions 74, 76 of the drive shaft 30, the waist 80 is more susceptible to twisting and other types of deformation when exposed to a rotational load. This arrangement is advantageous for protecting motor components such as the transmission 50 and crankshaft from damage due to impact forces, because the impact force will be at least partially absorbed by the waist portion 80. Accordingly, damage is minimized by providing the waist portion of relatively small diameter.

As also discussed above, conventional drive shafts typically include a waist portion of reduced diameter. Such a conventional waist portion, however, has a substantially uniform diameter (i.e. a constant diameter±manufacturing tolerances) along its length. Testing has shown that the tapered waist portion of the present embodiment significantly improves drive shaft strength performance when subjected to an impact force.

Figure 3:
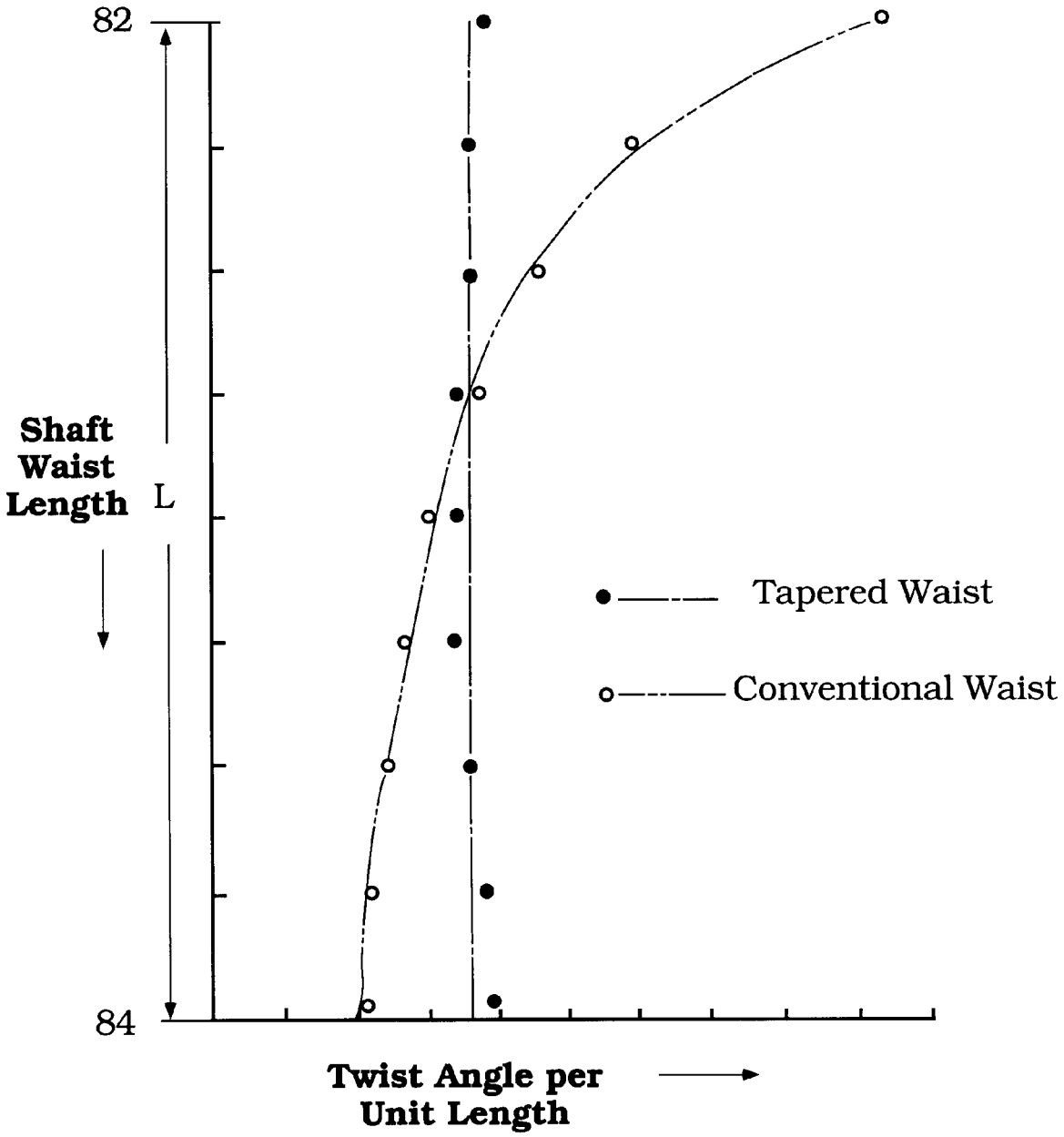
FIG. 3 is a graph showing test data of the twist angle per unit length versus the shaft waist length of a conventional drive shaft and the drive shaft of FIG. 2.

FIG. 3 graphically presents test data obtained from applying impact forces to both a conventional drive shaft 30 and the drive shaft of FIG. 2. The test data was obtained by impulsively applying a pre-arranged twisting torque to the upper portion 74 of the drive shaft while a bottom portion 76 of the drive shaft was fixed. This test arrangement simulates a propeller contacting a rocky shoal or the like, and thus becoming locked in place while the engine is still running. The magnitude of twisting torque applied to the drive shaft was determined based on actual impact data measured when a propeller suddenly becomes locked while the engine is still running.

For purposes of the test, the conventional drive shaft and tapered waist drive shaft both had waist portions of substantially the same length L, and the upper and lower ends 82, 84 of the waist portions of both drive shafts are labeled the same in the graph.

As illustrated in FIG. 3, the deformation of the conventional drive shaft is greatest at points closest to the uppermost portion 82 of the waist. At these high magnitudes, the deformation can be plastic and the shaft may fail. This is consistent with previous findings that failure of conventional drive shafts in the waist portion generally occurs in the portion of the waist closest to the engine.

With continued reference to FIG. 3, the tapered waist portion 80 of the drive shaft 30 illustrated in FIG. 2 has a generally consistent twist angle per unit length over the entire length L of the waist. This is because the tapered geometry helps distribute impact forces along the length of the waist, thus decreasing the magnitude of deformation near the upper end 82 of the waist section 80. Accordingly, a tapered waist not only minimizes damage from an impact force to motor components such as the transmission and crankshaft, but its tapered geometry also protects the drive shaft itself from damage from such impact forces.

Although the embodiment illustrated in FIG. 2 preferably has a waist length L of about 300 millimeters and the difference in the diameters D1, D2 is about 0.5 to 1 millimeter, it is to be understood that drive shafts have varying lengths and are made of various types of materials. Also, engine power varies between models, resulting in differing loads being exerted on the associated drive shafts. Since individual drive shafts come in various sizes and materials, the taper of FIG. 2, wherein the difference in diameters is between about 0.5 to 1 millimeter, may not be appropriate for all drive shafts. Because of the various factors considered, it is to be understood that varying drive shaft designs can incorporate tapers that may be more or less dramatic than that of the embodiment shown in FIG. 2. In any case, a tapered waist portion may be readily customized by one skilled in the art for a particular drive shaft to accomplish the force distributing characteristics illustrated in FIG. 3.

Figure 4:
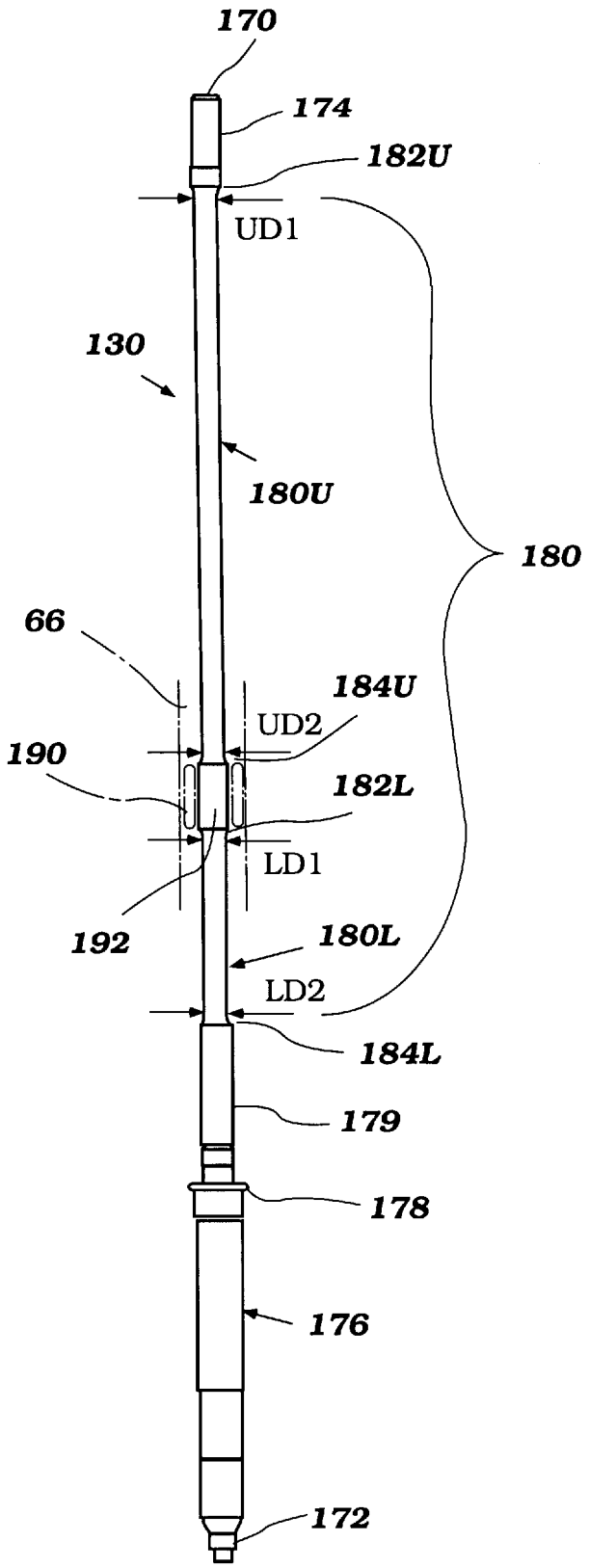
FIG. 4 shows a drive shaft having features in accordance with a second embodiment of the present invention.

With reference to FIG. 4, an additional embodiment of a drive shaft 130 having a tapered waist portion 180 is shown. The drive shaft 130 of FIG. 4 shares certain aspects and features with the drive shaft 30 of FIG. 2, such as an upper portion 174 adapted to be coupled with an engine crankshaft and a lower portion 176 adapted to engage a transmission and support rotatable mountings such as a thrust bearing 178. The tapered waist portion 180 is defined between the upper and lower portions 174, 176. In order to provide further stability and rotational support for the drive shaft 130, a bushing 190 is disposed midway-between the drive shaft upper and lower ends 170, 172. The bushing 190 is preferably press-fit into the driveshaft chamber 66 and cooperates with a bearing surface 192 of the drive shaft 130. The bearing surface 192, as with other support portions of the drive shaft 130, has a substantially uniform diameter greater than that of the waist portion 180.

The waist 180 of the drive shaft 130 extends both above and below the bearing surface 192. Thus, the bearing surface 192 divides the waist 180 into an upper waist portion 180U and a lower waist portion 180L. The upper and lower waist portions 180U, 180L are tapered in order to distribute the impact forces. Thus, a diameter UD1 of the waist portion at the upper end 182U of the upper waist 180U is greater than a diameter LD2 of the waist portion at the bottom end 184L of the lower waist 180L. Additionally, the taper is preferably gradual from the lower end 184L of the lower waist 180L to the upper end 182U of the upper waist 180U, being interrupted only by the bearing surface 192. Thus, a diameter LD1 at the upper end 182L of the lower waist 180L is preferably less than or equal to a diameter UD2 of the lower end 184U of the upper waist 180U.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A marine propulsion unit comprising an engine adapted to drive an output shaft, the output shaft being drivingly engaged with a drive shaft, the drive shaft having a first end portion, a second end portion, and an elongate waist portion disposed between the first and second end portions, the first end portion being driven by the output shaft, the second end portion driving a propulsion device, the waist portion being tapered along its length in a manner so that when a torque is applied to the first end portion with the second end portion being substantially fixed, the waist portion twists, and a twist angle per unit length is generally consistent along the length of the waist portion.

2. The propulsion unit of claim 1, wherein the drive shaft waist portion connects to the first end portion at a primary end of the waist and connects to the second end portion at a secondary end of the waist, and the primary end of the waist has a greater diameter than the secondary end of the waist.

3. The propulsion unit of claim 2, wherein the drive shaft waist diameter at the primary end is about 0.5 to about 1 millimeters greater than the drive shaft waist diameter at the secondary end.

4. The propulsion unit of claim 3, wherein the drive shaft waist portion is about 300 millimeters long.

5. The propulsion unit of claim 1, wherein the diameter of the waist portion is smaller than the diameters of the first and second end portions.

6. The propulsion unit of claim 1, wherein the propulsion device comprises a propeller.

7. The propulsion unit of claim 1 additionally comprising a second elongate waist portion disposed between the second end portion and the first waist portion.

8. The propulsion unit of claim 7, wherein the first and second waist portions are separated by a raised portion.

9. The propulsion unit of claim 8, wherein the raised portion defines a bearing surface adapted to cooperate with a bushing.

10. The propulsion unit of claim 8, wherein the second waist portion is tapered along its length.

11. The propulsion unit of claim 1, wherein the waist portion is formed of a material having different properties than the material used to form the second end portion.

12. The propulsion unit of claim 11, wherein the waist portion is formed of stainless steel.

13. The propulsion unit of claim 12, wherein the second end portion is formed of chrome steel.

14. An outboard motor comprising an internal combustion engine adapted to drive a crankshaft, a drive shaft having a top portion, a bottom portion, and an elongate waist extending from the top portion to the bottom portion and connected to the top portion at a top end and connected to the bottom portion at a bottom end, the drive shaft top portion coupled to the crankshaft, the elongate waist being continuously tapered along its length so as to have a larger diameter at the top end than at the bottom end, said waist having an average diameter less than an average diameter of both the top and bottom portion, the drive shaft bottom portion driving a transmission, and an output shaft coupled to the transmission, the output shaft driving a propulsion device.

15. The outboard motor of claim 14, wherein the bottom portion comprises a bearing support.

16. The outboard motor of claim 15, wherein the waist is formed of a different material than the bottom portion.

17. The outboard motor of claim 14, wherein the waist is about 300 millimeters long and the diameter of the waist at the top end is about 0.5 to about 1 millimeters greater than the diameter of the waist at the bottom end.

18. A drive shaft for use in conjunction with a marine drive, the drive shaft comprising a first end portion adapted to be coupled to a crankshaft of an internal combustion engine, a second end portion adapted to drive a propulsion device, and an elongate waist portion disposed between the first and second end portions, the waist portion having a first end and a second end and being substantially continuously tapered from the first end to the second end so that a diameter of the waist portion at the first end is greater than a diameter of the waist portion at the second end, a length from the first end to the second end of the waist portion being greater than a length of either the first end portion or the second end portion of the drive shaft.

19. The drive shaft of claim 18, wherein the waist portion is formed of a material having different properties than the material forming the second end portion.

20. The drive shaft of claim 19, wherein the waist portion is formed of stainless steel.

21. The drive shaft of claim 19, wherein the waist portion is formed of chrome steel.

22. The drive shaft of claim 18, wherein the diameter of the waist portion is smaller than the diameter of the second end portion.

23. A marine propulsion unit comprising an engine adapted to drive an output shaft, the output shaft being drivingly engaged with a drive shaft, the drive shaft having a first end portion driven by the output shaft, a second end portion driving a propulsion device, a first elongate waist portion disposed between the first and second end portions, the waist portion being tapered along its length, and a second elongate waist portion disposed between the second end portion and the first waist portion, wherein the first and second waist portions are separated by a raised portion, and a diameter of said raised portion being greater than an average diameter of both of said first and second waist portion.

24. The propulsion unit of claim 23, wherein the raised portion defines a bearing surface adapted to cooperate with a bushing.

25. The propulsion unit of claim 23, wherein the second waist portion is tapered along its length.

26. The propulsion unit of claim 25, wherein an upper end of the second waist portion has a greater diameter than a lower end of the second waist portion.

27. The propulsion unit of claim 23, wherein the diameter of the first waist portion adjacent the first end portion is greater than the diameter of the second waist portion adjacent the second end portion.

28. The propulsion unit of claim 27, wherein the first waist diameter adjacent the first end portion is about 0.5 to about 1 millimeters greater than the second waist diameter adjacent the second end portion.

29. The propulsion unit of claim 28, wherein the combined length of the first and second waist portions is about 300 millimeters.

30. The propulsion unit of claim 23, wherein the diameter of the first waist portion is smaller than the diameters of the first and second end portions.

31. The propulsion unit of claim 30, wherein the diameter of the second waist portion is smaller than the diameters of the first and second end portions.

32. A torsion-distributing driveshaft for a marine drive having an engine configured to drive a propulsion device, the driveshaft comprising a first portion configured to be coupled to an output shaft of the engine, a second portion configured to drive the propulsion device, and an elongate waist extending from the first portion to the second portion, the waist having an average diameter less than an average diameter of both the first and second portions, the first portion having a transition portion connecting the first portion with a first end of the waist, the second portion having a transition portion connecting the second portion with a second end of the waist, and the diameter of the waist is greater at the first end than at the second end, said waist being substantially continuously tapered from the first end to the second end.

33. The driveshaft of claim 32, wherein the waist is continuously tapered from the first end to the second end.

34. The driveshaft of claim 32, wherein the first transition portion is configured to reduce the diameter of the driveshaft from a diameter of the first portion to the diameter of the first end of the waist.

35. The driveshaft of claim 34, wherein the second transition portion is configured to reduce the diameter of the driveshaft from a diameter of the second portion to the diameter of the second end of the waist.

36. The driveshaft of claim 32, wherein the daimeter of the waist varies along its length so that when a torque is applied to the driveshaft, a torsional twist angle along the length of the waist is generally consistent.

37. The driveshaft of claim 32, wherein the first portion and the second portion each comprise a bearing surface.

38. The driveshaft of claim 32, wherein at least one of the first portion and second portion comprises a component mount portion.

39. The driveshaft of claim 38, wherein the component mount portion comprises a water pump drive mount.

40. A marine drive comprising an engine having an output shaft, a propulsion device, and a torsion-distributing driveshaft having a first connecting portion configured to be coupled to the output shaft and a second connecting portion configured to drive the propulsion device, the driveshaft further comprising an elongate waist between the first and second portions, the waist having an average diameter less than an average diameter of both the first and second portions, and comprising means for distributing a torsional load so that a twist angle per unit length of the waist is generally consistent along the length of the waist when a torsional load is applied to the first connecting portion of the driveshaft and the second connecting portion is held generally in place.

41. The marine drive of claim 40, wherein the elongate waist has a length greater than a length of either the first connecting portion or the second connecting portion.

* * * * *